US006533019B1

(12) United States Patent
King et al.

(10) Patent No.: US 6,533,019 B1
(45) Date of Patent: Mar. 18, 2003

(54) PARTITION PANEL WITH INFILL ARRANGEMENT

(75) Inventors: Jonathan J. King, East Grand Rapids, MI (US); Alan E. Rheault, Grand Rapids, MI (US); John S. Malnor, East Grand Rapids, MI (US); Joel T. Ruiter, Grand Haven, MI (US)

(73) Assignee: Steelcase Development Corporation, Caledonia, MI (US)

( * ) Notice: Subject to any disclaimer, the term of this patent is extended or adjusted under 35 U.S.C. 154(b) by 0 days.

(21) Appl. No.: 09/693,225

(22) Filed: Oct. 20, 2000

(51) Int. Cl.[7] ..... A47G 5/00

(52) U.S. Cl. ..... 160/351; 52/239; 52/770; 403/396

(58) Field of Search ..... 160/351; 52/239, 52/770; 403/220, 226, 396

(56) References Cited

U.S. PATENT DOCUMENTS

| | | | | |
|---|---|---|---|---|
| 3,384,148 | A | | 5/1968 | Sarginson et al. |
| 3,428,108 | A | * | 2/1969 | Singer |
| 3,875,711 | A | | 4/1975 | Palmer |
| 3,888,029 | A | | 6/1975 | Schubert |
| 3,913,978 | A | | 10/1975 | Lester |
| 4,063,585 | A | | 12/1977 | Stanley |
| 4,268,000 | A | | 5/1981 | Uml |
| 4,512,097 | A | | 4/1985 | Zeigler |
| 4,633,899 | A | | 1/1987 | Lord |
| 4,637,180 | A | | 1/1987 | Zeigler |
| 4,774,792 | A | | 10/1988 | Balance |
| 5,031,683 | A | * | 7/1991 | Marvy et al. |
| 5,038,539 | A | * | 8/1991 | Kelley et al. |
| 5,642,557 | A | | 7/1997 | Clews |
| D400,361 | S | * | 11/1998 | Sobrito |
| 6,061,972 | A | * | 5/2000 | Thorp |
| 6,161,320 | A | | 12/2000 | Peterson |
| 6,279,643 | B1 | * | 8/2001 | Shipman |

FOREIGN PATENT DOCUMENTS

| | | |
|---|---|---|
| WO | WO0021412 | 10/1999 |

* cited by examiner

*Primary Examiner*—Blair M. Johnson
(74) *Attorney, Agent, or Firm*—Price, Heneveld, Cooper, DeWitt & Litton

(57) ABSTRACT

A partition panel for office systems includes a rigid panel frame having a generally rectangular perimeter and a generally rectangular opening therethrough. The panel frame has a base configured to abuttingly support the panel frame freestanding on a floor surface. The panel frame includes a row of openings configured to support hang-on accessories. The partition panel also includes at least four H-shaped connectors, each of which is secured to said panel frame adjacent each side of the rectangular opening. A rigid sheet is secured to the frame by the connectors, and spans at least a substantial portion of the rectangular opening.

7 Claims, 5 Drawing Sheets

PARTITION PANEL WITH INFILL ARRANGEMENT

BACKGROUND OF THE INVENTION

Modern offices are becoming increasingly complicated and sophisticated due largely to the ever increasing needs of the users for improved utilities support at each workstation, such as communications, computers and other types of data processors, electronic displays, etc., including physical accommodations, such as lighting, HVAC, security, and the like. For example, modern offices for highly skilled "knowledge workers" such as engineers, accountants, stock brokers, computer programmers, etc., are typically provided with multiple pieces of very specialized computer and communications equipment that are capable of processing information from numerous local and remote data resources to assist in solving incredibly complex problems. Such equipment has very stringent power and signal requirements, and must quickly and efficiently interface with related equipment at both adjacent and remote locations. Work areas with readily controllable lighting, HVAC, sound masking, and other physical support systems, are also highly desirable to maximize worker creativity and productivity. Many other types of high technology equipment and facilities are also presently being developed which will find their place in the workplaces of the future.

One important consequence of the advent of sophisticated electronic offices is the increased need and desirability for distributing utilities throughout the various offices in a manner which can be readily reconfigured. The term "utilities" as used herein incorporates a wide variety of facilities for use at a workstation, including security devices, electrical power, signal and/or communications, HVAC, water and other fluids, and other similar resources. The ability to provide the worker with ready access to all of these utilities is clearly advantageous in the quest to promote worker well being and effectiveness.

The efficient use of building floor space is also an ever growing concern, particularly as building costs continue to escalate. Open office plans have been developed to reduce overall officing costs, and generally incorporate large, open floor spaces in buildings that are equipped with modular furniture systems which are readily reconfigurable to accommodate the ever changing needs of a specific user, as well as the divergent requirements of different tenants. One arrangement commonly used for furnishing open plans includes movable partition panels that are detachably interconnected to partition off the open spaces into individual workstations and/or offices. Such partition panels are configured to receive hang-on furniture units, such as worksurfaces, overhead cabinets, shelves, etc., and are generally known in the office furniture industry as "systems furniture". Another arrangement for dividing and/or partitioning open plans includes modular furniture arrangements, in which a plurality of differently shaped, freestanding furniture units are positioned in a side-by-side relationship, with upstanding privacy screens attached to at least some of the furniture units to create individual, distinct workstations and/or offices. Both of these types of modular furniture systems, as well as others, have been widely received due largely to their ability to be readily reconfigured and/or moved to a new site, since they are not part of a permanent leasehold improvement.

In order to gain increased efficiency in the use of expensive office real estate, attempts are now being made to try to support high paid knowledge workers with these types of modular furniture systems in open office settings, instead of conventional private offices. However, in order to insure peak efficiency of such knowledge workers, the workstations must be equipped with the various state-of-the-art utilities and facilities discussed above. Since such workstations must be readily reconfigurable to effectively meet the ever changing needs of the user, the distribution and control of utilities throughout a comprehensive open office plan has emerged as a major challenge to the office furniture industry.

Although such systems are generally capable of providing office spaces for workers, such systems may not provide for varying degrees of privacy. Furthermore, when reconfiguring such a system, the level of privacy cannot be readily changed. Furthermore, because the cover panels utilized with such systems may be relatively expensive, the cost of changing the cover panels to provide a new appearance may be prohibited. Still further, such systems commonly utilize a single type of cover panel throughout the system, leading to a very uniform, impersonal working environment.

SUMMARY OF THE INVENTION

One aspect of the present invention is to provide a partition panel for office systems including a rigid panel frame having a generally rectangular perimeter and a generally rectangular opening therethrough. The panel frame has a base configured to abuttingly support the panel frame freestanding on a floor surface. The panel frame includes a row of openings configured to support hang-on accessories. The partition panel also includes at least four fabric connectors, each of which is secured to said panel frame adjacent each comer of the rectangular opening. A thin flexible fabric sheet is secured to the fabric connectors, and spans at least a substantial portion of the rectangular opening.

Another aspect of the present invention is a partition panel for office systems including a rigid panel frame having a generally rectangular perimeter and at least one horizontally extending frame member. The rigid panel frame defines an enlarged opening through a central portion of the frame. A sheet of rigid material is disposed within, and spans the enlarged opening. At least one connector supports the sheet within the opening. The connector defines first and second oppositely opening slots, with the horizontally extending frame members received in the first slot, and an edge of the sheet received in the second slot.

Yet another aspect of the present invention is a partition panel for offices including a rigid panel frame having a pair of vertically spaced apart horizontal frame members and a pair of frame members extending vertically between and rigidly interconnecting the horizontal frame members to define an enlarged opening through the panel frame. A thin sheet of flexible material extends across at least a portion of the enlarged opening, and at least one clamp is secured to the panel frame. The clamp is releasably clamped to the sheet at an edge thereof.

Yet another aspect of the present invention is a partition panel including a rigid panel frame defining a vertical side face and having an opening through a central portion thereof. A sheet extends across and closes of the opening. The partition panel further includes a retainer on the panel frame, the retainer having a groove receiving the edge of the sheet. A side edge of the groove is defined by a cantilevered flexible member extending at an angle away from the vertical side face and towards the central portion when in an unstressed state, such that an edge of the sheet slides on the flexible member and flexes the flexible member during installation. The flexible member returns to the unstressed state when the sheet is in the installed position to retain the edge of the sheet.

These and other features, advantages, and objects of the present invention will be further understood and appreciated by those skilled in the art by reference to the following specification, claims, and appended drawings.

DETAILED DESCRIPTION OF PREFERRED EMBODIMENTS

Figure 1:
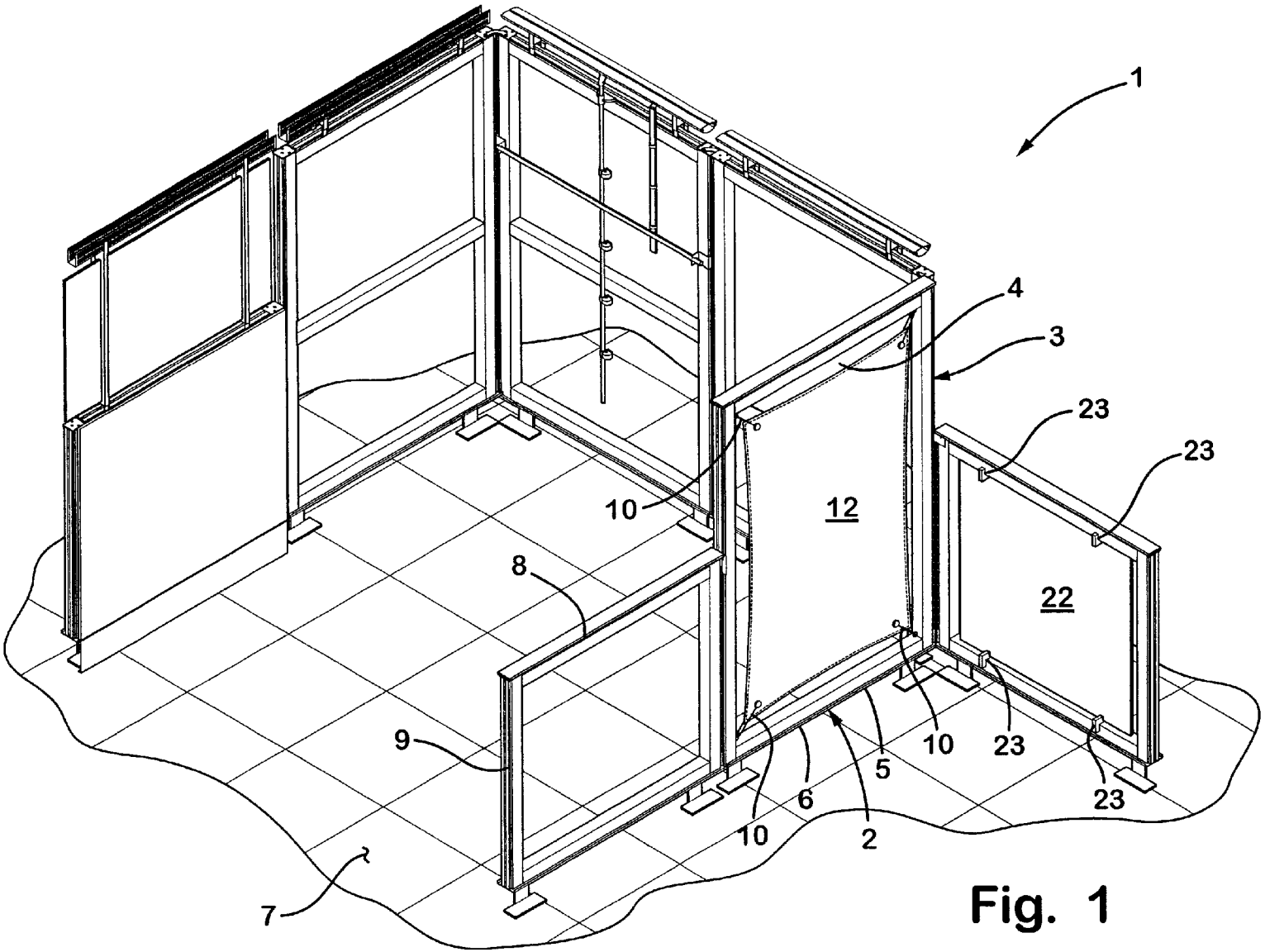
FIG. 1 is a perspective view of a partition panel and infill arrangement embodying the present invention.

For purposes of description herein, the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

With reference to FIG. 1, a partition system 1 includes a partition panel 2 having a rigid panel frame 5 having a generally rectangular perimeter 3 and a generally rectangular opening 4 therethrough. The panel frame 5 has a base 6 configured to abuttingly support the panel frame freestanding on a floor surface 7. The panel frame includes a horizontal row of openings 8 and a vertical row of openings that may be utilized to support hang-on accessories such as worksurfaces, storage bins and the like. At least four fabric connectors, such as wire hooks 10 are secured to the panel frame 5 adjacent each corner 11 of the rectangular opening 4. A thin, flexible fabric sheet 12 is secured to the fabric connectors 10, and spans at least a substantial portion of the rectangular opening 4 in the panel frame 5.

The present application is related to the following co-pending patent applications, the entire contents of each of which are hereby incorporated herein by reference.

| Application No. | Filing Date | Title |
|---|---|---|
| 09/692786 | Even date herewith | PARTITION PANEL |
| 09/692663 | Even date herewith | PARTITION SYSTEM WITH ELEVATED RACEWAY |
| 09/693316 | Even date herewith | PARTITION SYSTEM WITH WORKTOOLS |
| 09/692796 | Even date herewith | TOP CAP AND SCREEN FOR PARTITIONS |

The panel frame 5 includes vertical frame members 13, and a horizontal frame member 14, and a lower horizontal frame member 15 and feet or glides 16 that support the frame 5 on a floor surface 7. The panel frame 5 is described in detail in the above-identified co-pending patent application entitled PARTITION PANEL, and will therefor not be described in detail herein.

Figure 4:
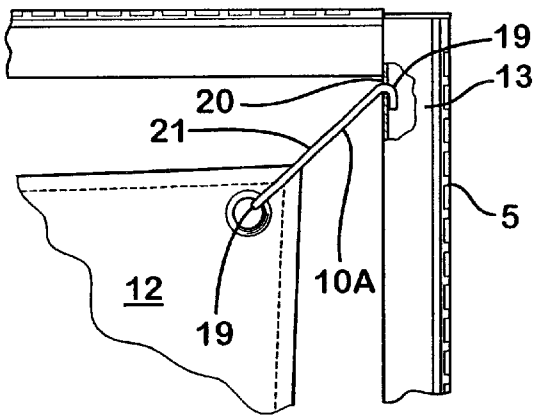
FIG. 4 is a fragmentary view illustrating a portion of the partition frame wherein an opening in the frame is utilized to support the fabric sheet.
Figure 2:
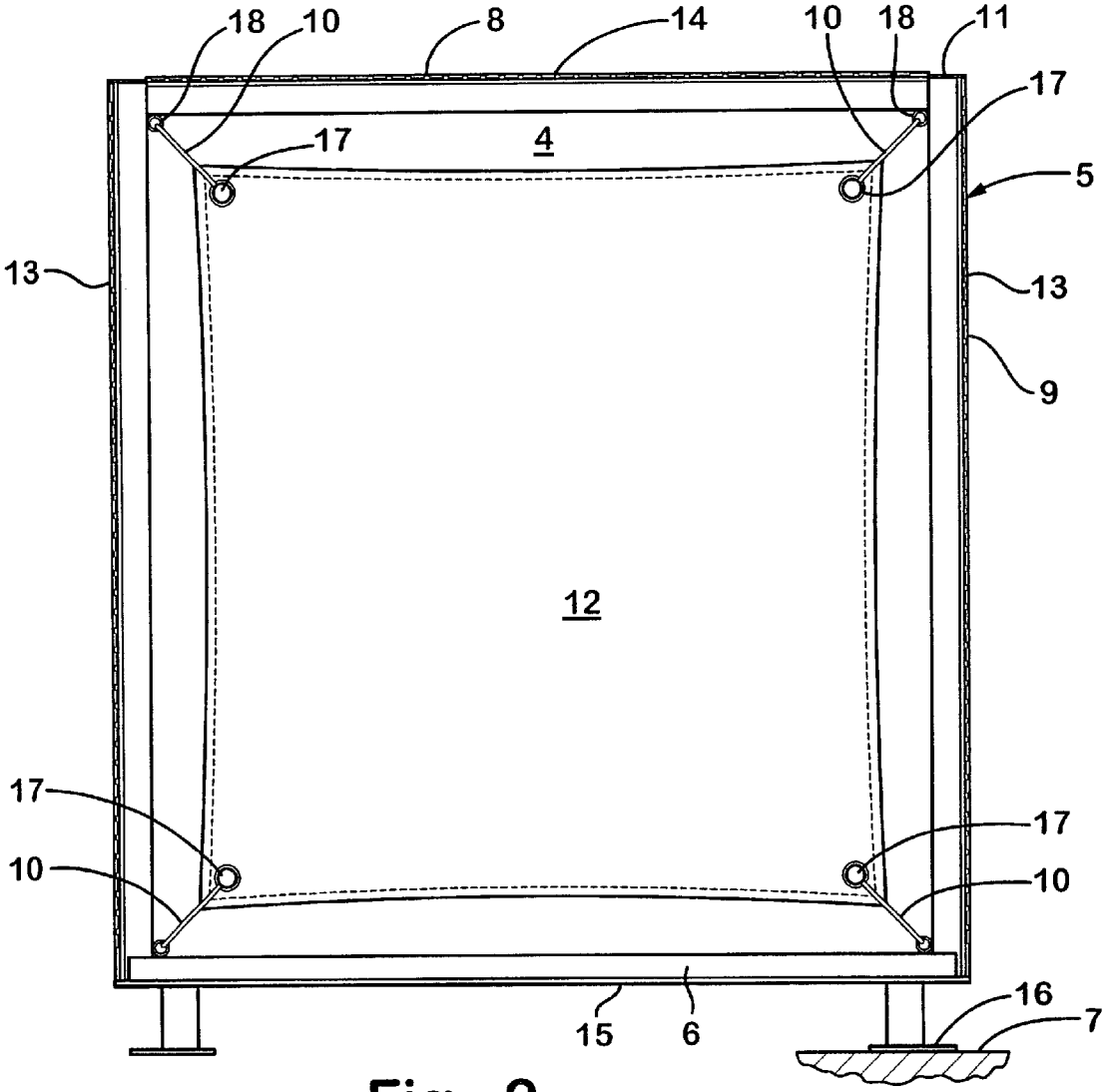
FIG. 2 is a front elevational view of a partition panel including a flexible infill arrangement.
Figure 5:
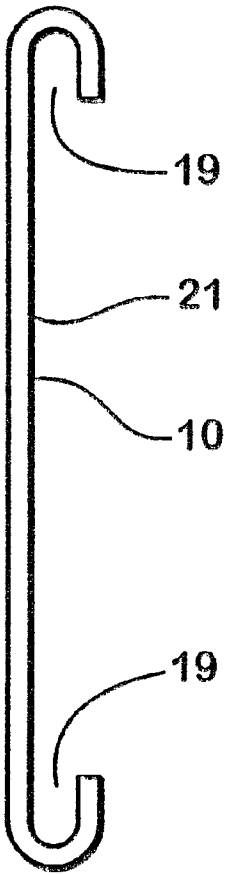
FIG. 5 illustrates a hook that may be utilized to support the fabric sheet of FIG. 2.

The flexible fabric sheet 12 includes grommets 17 at each corner thereof to provide reinforcement where connected to the hook connector 10. Rings 18 are secured to the frame 5, and the hooked ends 19 (see also FIG. 5) of the connector 10 are received in the ring 18 and the grommet 17 to retain the fabric sheet 12 in the panel frame 5. The fabric sheet 12 may be cloth, plastic, or any other material providing the desired affect. The sheet 12 could be opaque, or could comprise a frosted or translucent colored sheet of polymer providing an intermediate level of privacy. As illustrated in FIG. 4, rather than the rings 18, the side frame member 13 could include an opening 20 at each corner that receives the hooked end 19 of a hooked connector 10A. Hook connector 10A is substantially the same as connector 10, except that the hooked end portions 19 are oriented at 90 degrees relative to one another about an axis extending along the center section 21 of the hook 10, rather than oriented in the same plan as the hooked connector 10 illustrated in FIG. 5.

Figure 3:
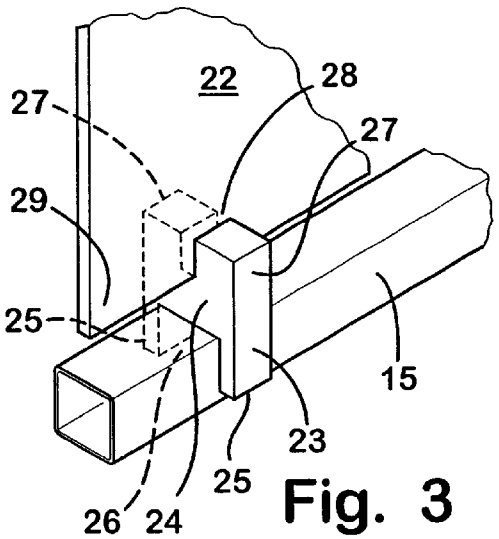
FIG. 3 is a fragmentary, perspective view illustrating a retainer that can be used to support a rigid sheet of material in a partition frame.

A rigid sheet of material 22 may be supported in the panel frame 5 by an H-shaped retainer 23. The H-shaped retainer 23 includes a central portion 24 and a first pair of legs 25 extending away from the central portion 24 and defining a generally U-shaped slot 26 that receives a frame member 13, 14, or 15. A second pair of legs 27 extends away from the central portion 24 of the retainer 23 in an opposite direction from the first pair of legs 25, and form a second generally U-shaped slot 28 that opens in an opposite direction relative to the first U-shaped slot 26. The second U-shaped slot 28 receives the lower edge portion 29 of the rigid sheet 22 to thereby support the sheet 22 in the panel frame 5. As illustrated in FIG. 1, four or more of the H-shaped retainers 23 may be utilized to retain the rigid sheet 22. The rigid sheet 22 may be opaque, translucent, or frosted as required to provide the desired degree of privacy and/or light transmissibility. The sheet 22 may be quickly and easily changed as required by simply rotating the H-shaped connector to a position wherein the legs 25 and 27 extend parallel to the frame member 15. The sheet 22 can then be removed, and a different sheet 22 can be installed by rotating the connector 25 back to the position illustrated in FIG. 3. Rigid sheet 22 may also include an opening similar to that provided by grommets 17, such that rigid sheet 22 could be mounted utilizing connectors 10 or 10A.

Figure 8:
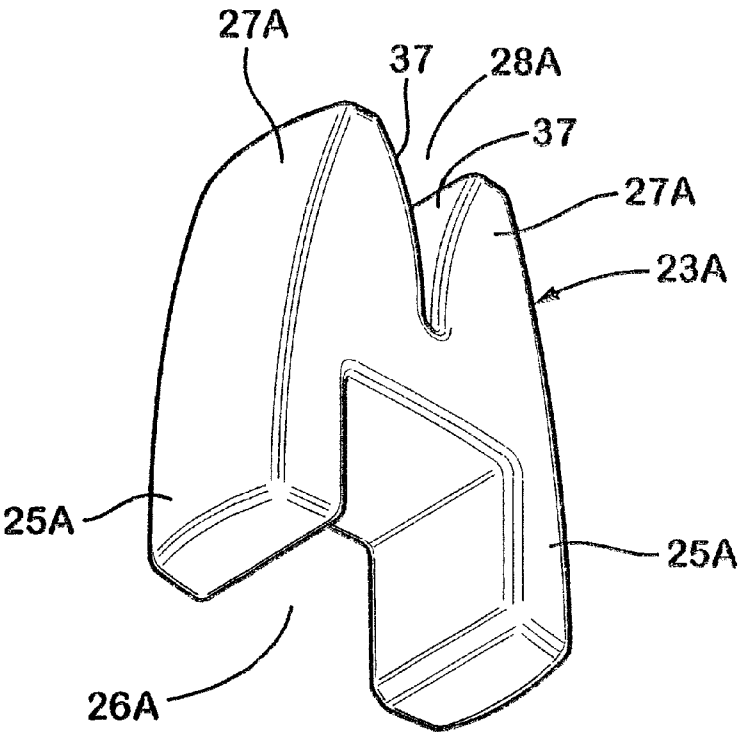
FIG. 8 is a perspective view of a second embodiment of the retainer of FIG. 3.

With further reference to FIG. 8, a second embodiment 23A of the H-shaped retainer includes a slot 28A having convex, curved sidewalls 37, such that the slot 28A has an approximate V-shape. Because the slot 28A varies in width, the slot 28A may receive the lower edge 29 of rigid sheets 22 of varying thickness. The legs 25A and 27A are otherwise substantially similar to the corresponding legs described above in connection with the H-shaped retainer illustrated in FIG. 3.

Figure 9:
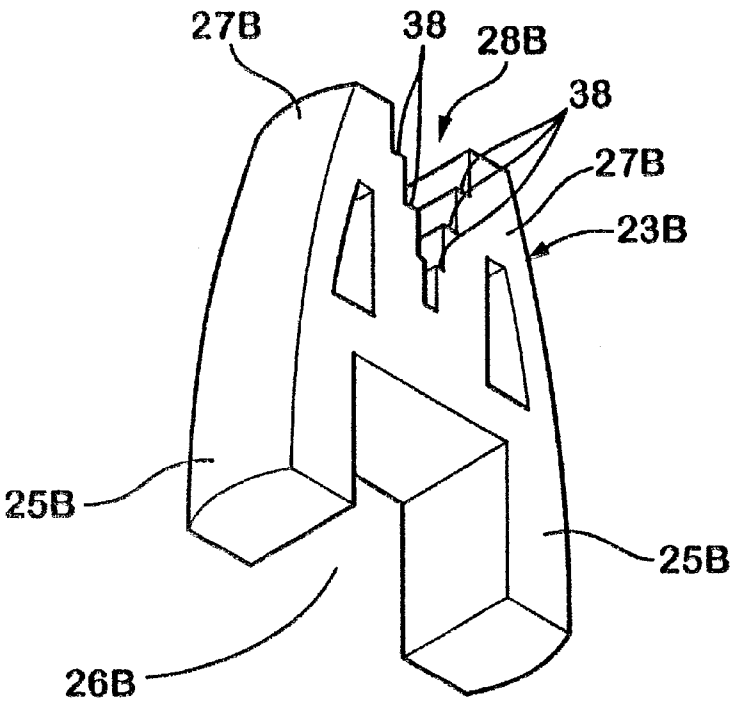
FIG. 9 is a perspective view of a third embodiment of the retainer of FIG. 3.

With further reference to FIG. 9, a third embodiment 23B of the H-shaped retainer includes a slot 28B including a plurality of steps or ledges 38, such that the slot 28B varies in thickness to accommodate rigid sheets 22 of varying thickness. The legs 25B and 27B are otherwise substantially similar to the corresponding components described above in connection with the H-shaped retainer 23 illustrated in FIG. 3. Connectors 23, 23A, and 23B may be made of a polymer or other suitable material.

Figure 6:
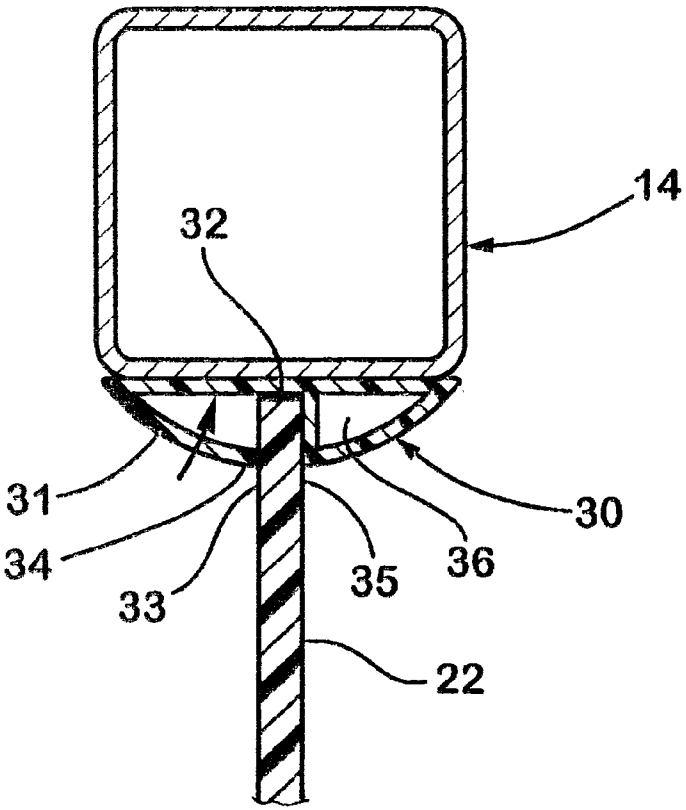
FIG. 6 is a fragmentary cross-sectional view illustrating another retainer that may be utilized to hold a rigid sheet in the panel frame.

Alternately, rigid sheet 22 may be secured by an edge connector 30 (FIG. 6). Edge connector 30 includes a flexible flap 31 that flexes inwardly when contacted by the edge 32 of rigid sheet 22 during installation. The flap 31 then shifts outwardly, and the end edge 34 of the flexible flap 31 contacts the side surface 33 of sheet 22 to retain the sheet 22 in position. The rear sidewall 35 of the tubular rear portion 36 of the edge connector 30 and the end 34 of flap 31 together form a groove that retains the edge portion of the sheet 22. The edge connector 30 may extend along the entire length of the upper frame member 14, and along the vertical frame members 13 and lower frame member 15. Alternately, the connector 30 may extend along the upper horizontal member 14 only, with a groove (not shown) being provided in the lower horizontal frame member 15 to support the lower edge of the sheet 22. Also, the edge connector 30 may be a relatively short member that connects only a portion of the edge 32 of the sheet 22, in a similar manner to the H-shaped retainer 23 described above.

Figure 7:
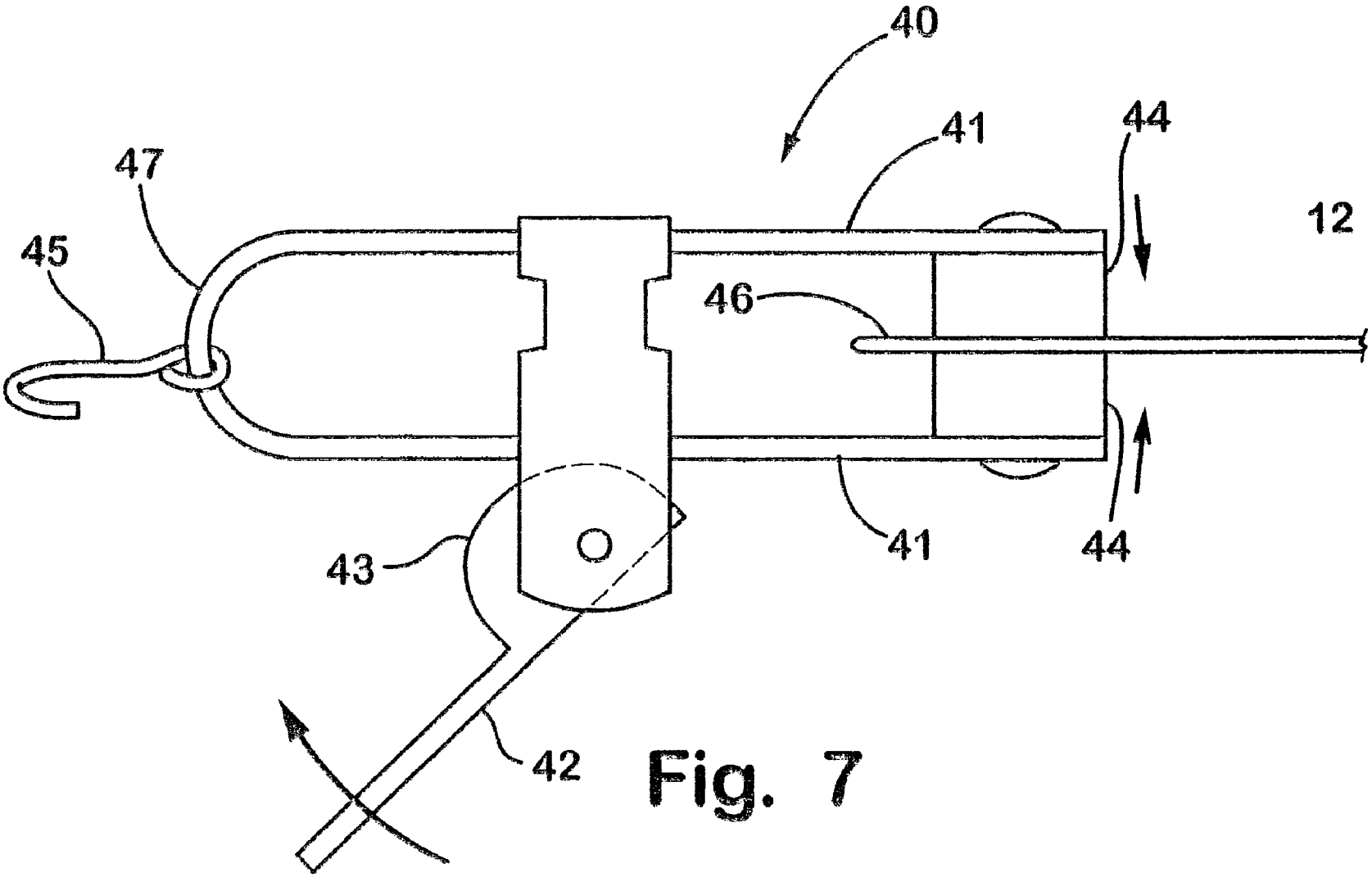
FIG. 7 illustrates a clamp that may be utilized to clamp onto the edge of the fabric sheet.

With further reference to FIG. 7, a clamp 40 may be utilized instead of the hook connectors 10 or 10A described above to secure the flexible fabric sheet 12 or rigid sheet 22 in the panel frame 5. The clamp 40 includes a pair of flexible arms 41, and a pair of pads 44. Handle 42 includes a cam surface that forces the arms 41 together and clamps the pads 44 onto the edge portion 46 of the flexible fabric sheet 12. In the illustrated example, clamp 40 is a "Grid Clamp", Part No. 6030 available from Convenience Concepts of Addison, Ill. A hook 45 made of wire or the like is secured to the base portion 47 of the clamp 40, and may be utilized to connect the clamp 40 to either the rings 18 or the opening 20, as described above in connection with the connectors 10 and 10A.

The flexible fabric sheet 12 may be readily removed or replaced to vary the degree of privacy in the partition system. Furthermore, the rigid sheets 22 may also be quickly and easily removed or changed, without the use of tools, and also without requiring modifications or otherwise damaging the partition frame 5.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The invention claimed is:

1. A partition panel for office systems, comprising:

a rigid panel frame having a generally rectangular perimeter and at least one horizontally extending frame member defining a horizontal axis, said rigid panel frame defining an enlarged opening through a central portion of said frame;

a sheet of rigid material disposed within and substantilly spanning said enlarged opening;

at least one connector supporting said sheet within the opening, said connector comprising a one piece member defining first and second oppositely opening slots, said horizontally extending frame member engaging said first slot and forming a couple therewith that prevents rotation of said connector about said axis of said horizontal frame member, and wherein an edge of said sheet is received in said second slot.

2. The partition panel set forth in claim 1, wherein:

said frame member has a generally quadrilateral cross-section defining opposite side faces and an inner face, said first slot having parallel side walls fitting closely along said side faces to form said couple.

3. The partition panel set forth in claim 1, wherein:

said enlarged opening is rectangular with spaced apart upper and lower edges; and said connector comprises a first connector, said partition panel further including at least three additional connectors, each being substantially identical to said first connector, a first pair of said connectors disposed at said upper edge, and a second pair of said connectors disposed at said lower edge. .

4. The partition panel set forth in claim 1, wherein:

said sheet is opaque.

5. The partition panel set forth in claim 1, wherein:

said sheet is made of a light transmitting material.

6. A partition panel for office systems, comprising:

a rigid panel frame having a generally rectangular perimeter and at least one frame member defining a first axis and opposite side faces, each having spaced apart engagement portions, said rigid panel frame defining an enlarged opening through a central portion of said frame;

a sheet of rigid material disposed within and substantially spanning said enlarged opening;

at least one connector supporting said sheet within the opening, said connector defining first and second oppositely opening slots, said first slot defining spaced apart side surfaces, at least a portion of said frame member received in said first slot with said spaced apart engagement portions of said frame member engaging portions of said side surfaces of said first slot to prevent rotation of said connector about said axis, and wherein an edge of said sheet is received in said second slot, said connector being rotatable about a second axis substantially orthogonally to said first axis.

7. The partition panel set forth in claim 6, wherein:

said opposite side faces of said frame member are substantially flat; and said side surfaces of said first slot are substantially flat and fit closely against said side faces.

* * * * *